US005140371A

United States Patent [19]

Ishihara et al.

[11] Patent Number: 5,140,371

[45] Date of Patent: Aug. 18, 1992

[54] CONTACT CHARGING MEMBER, CONTACT CHARGING METHOD MAKING USE OF IT, AND APPARATUS MAKING USE OF IT

[75] Inventors: Yuji Ishihara, Kawasaki; Tetsuya Kuribayashi, Tokyo; Takashi Tanaka; Shigemori Tanaka, both of Kawasaki, all of Japan

[73] Assignee: Canon Kabushiki Kaisha, Tokyo, Japan

[21] Appl. No.: 631,903

[22] Filed: Dec. 21, 1990

[30] Foreign Application Priority Data

Dec. 25, 1989 [JP] Japan ..... 1-337813

[51] Int. Cl.[5] ..... G03G 15/02

[52] U.S. Cl. ..... 355/219; 361/225

[58] Field of Search ..... 355/219, 202; 361/225, 361/221; 29/132; 252/511

[56] References Cited

FOREIGN PATENT DOCUMENTS 1-142569 6/1989 Japan ..... 355/219
1-172858 7/1989 Japan ..... 355/219
1-204081 8/1989 Japan ..... 355/219

*Primary Examiner*—Joan H. Pendegrass
*Attorney, Agent, or Firm*—Fitzpatrick, Cella, Harper & Scinto

[57] ABSTRACT

The present invention provides a contact charging member having a conductive layer free from resistance unevenness, comprising a conductive pigment and at least two kinds of polymeric elastic materials A and B, wherein the elastic material A has a higher affinity for the conductive pigment than the elastic material B.

13 Claims, 3 Drawing Sheets

CONTACT CHARGING MEMBER, CONTACT CHARGING METHOD MAKING USE OF IT, AND APPARATUS MAKING USE OF IT

BACKGROUND OF THE INVENTION

1. Field of the Invention

The present invention relates to a contact charging member fitted to an image forming apparatus such as an electrostatic copying machine. It also relates to an apparatus making use of it.

2. Related Background Art

The electrophotographic copying apparatus comprises a means for uniformly charging a charge-receiving member to a given potential. As a means for the charging, almost all of apparatus having been put into practical use utilize the corona charging method. This, however, has the problems that it requires a high voltage and also generates ozone in a large quantity.

Under such circumstances, recently proposed is a contact charging method in which a voltage is externally applied to a charging member and this charging member is brought into contact with a charge-receiving member.

According to this contact charging method, for example, a charging roller serving as a contact charging member is rotated in contact with an electrophotographic photosensitive drum serving as the charge-receiving member, where a $V_{AC}+V_{DC}$ voltage obtained by superimposing an alternating voltage $V_{AC}$ on a direct voltage $V_{DC}$ is applied to the charging roller, so that the photosensitive drum can be uniformly charged.

Hitherto, an elastic surface conductive layer, of a contact charging member such as a charging roller, is formed by dispersing a conductive pigment in a polymeric elastic material. However, it is difficult to obtain the uniform dispersibility of the conductive pigment not only for each contact charging member manufactured, but within a conductive layer of a contact charging member, resulting in an uneven resistance. This resistance unevenness brings about the following problems. For example, although the charging roller must be kept conductive, when a defect such as a pinhole has occurred in a photosensitive layer of a photosensitive drum comprising a conductive substrate and a photosensitive layer formed thereon and the resistance of the charging roller is excessively low, a large electriccurrent may flow, because of a leak, from the low-resistance part of the contact charging member into the pinhole area, lowering the output of a high voltage power supply, so that the photosensitive drum is poorly charged at the area of pinhole. On the other hand, at the area of high-resistance, the surface of the photosensitive drum can not be uniformly charged resulting in spot-like charge unevenness which, by an ordinary electrophotographic image forming process, gives an output image having black spots corresponding to the charge unevenness, so that high quality image can not be obtained.

SUMMARY OF THE INVENTION

A principal object of the present invention is, in order to solve the above problems of the contact charging member having a conductive layer which contains a dispersed conductive pigment therein, to provide a contact charging member having a conductive layer free from resistance unevenness.

Another object of the present invention is to provide a contact charging member having a superior performance for uniform charging, a contact charging method utilizing it, and an apparatus utilizing it.

The contact charging member according to the present invention comprises a conductive layer comprising a conductive pigment and at least two kinds of polymeric elastic materials A and B, wherein one polymeric elastic material has a higher affinity for the conductive pigment than the other.

The combination of polymeric elastic materials having different affinity of the conductive pigment brings about the contact charging member of the present invention free from the unevenness in resistance of the conductive layer and the resulting superior performance for uniform charging.

The conductive pigment must be uniformly dispersed in order to solve the problem of the resistance unevenness of the conductive layer.

However, in contact charging members with the conductive pigment merely dispersed in the elastic material as usual, the resistance becomes low when a large quantity of the conductive pigment is used, or the resistance becomes high when a small quantity of the conductive pigment is used. Although the resistance unevenness can be reduced in both cases, the contact charging member can not obtain a resistivity (a volume resistivity) of a medium resistance region, preferably in the range of from $10^3$ to $10^{12}$ Ω·cm.

Moreover, the dispersion of a medium amount of the polymeric elastic material may give resistivities of the medium resistance in average, but resulting in an increased unevenness of resistance. Hence, in both of the above intances, it is impossible to obtain the uniform charging.

In the present invention, the conductive layer is comprised of a combination of i) the fractions of a polymeric elastic material having a low resistance with reduced unevenness, which is formed by uniformly dispersing a conductive pigment in a polymeric elastic material having a high affinity for the conductive pigment, and ii) the fractions of a polymeric elastic material having a high resistance with reduced unevenness, which is formed by uniformly dispersing a conductive pigment in a polymeric elastic material having a low affinity for the conductive pigment. It is thus possible to obtain a contact charging member with a resistivity of a medium resistance region, with a small resistance unevenness and with stable charge characteristics.

The reason therefor is presumed as follows: In the medium resistance range the resistance is greatly influenced by the amount of the pigment added. Hence the local presence, compounding or destruction of the conductive pigment at the time of molding may directly cause the unevenness in resistance. On the other hand, as in the present invention, the coexistence of the low-resistance polymeric elastic material fractions (where the conductive pigment is dispersed in a large quantity or dispersion is fine) and the high-resistance polymeric elastic material fractions (where the conductive pigment is dispersed in a small quantity or not dispersed, or dispersion is coarse) can minimize the above influence at the time of molding.

DESCRIPTION OF THE PREFERRED EMBODIMENTS

Figure 1:
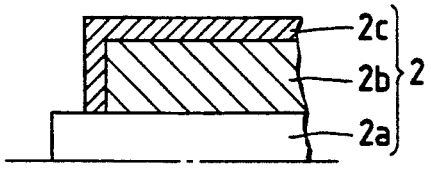
FIG. 1 illustrates an embodiment of the contact charging member according to the present invention.

The contact charging member of the present invention is so constructed that it is provided with a conductive layer comprising a conductive pigment and at least two kinds of polymeric elastic materials which satisfy the relation that one has a higher affinity for the conductive pigment than the other. It is thereby possible to supply a contact charging member having a resistivity within a medium resistance region, with a small resistance unevenness and an electrical stability. The charging member includes, for example, a charging roller, a charging blade and a transfer roller.

A method of evaluating the affinity may be in accordance with the method prescribed in ASTM-D2663-69. Alternatively, when the polymeric elastic materials A and B are present in the sea-islands like structure, in order to determine that one of the polymeric elastic material has a higher affinity for the conductive pigment than the other, followings should be confirmed by visual observation using TEM (transmission electron microscopy), SEM (scanning electron microscopy) or the like; i) the conductive pigment is dispersed in only the sea or the islands, ii) the amount of the pigment in one of them is larger than, preferably not less than twice, and more preferably not less than five times, that in the other, or iii) the pigment is dispersed in one of them in a finer state than in the other, and preferably in such a state that the apparent dispersed-particle diameter of the conductive pigment is not more than the half of that of the other.

Hardness can substitute the elastic modulus of the polymeric elastic material, which is commonly represented in the JISA type. In respect of the range of hardness, the polymeric elastic material A (having higher affinity for the pigment) may preferably have a hardness $H_A$ of not less than 30°; and the polymeric elastic material B (having lower affinity for the pitment), a hardness $H_B$ of not more than 40°. A polymeric elastic body comprising a mixture of the polymeric elastic material A and the polymeric elastic material B may have a hardness $H_{AB}$ that satisfies the relation of $H_{AB}+\alpha=H_A$ wherein $\alpha$ is preferably from 13 to 20 and particularly from 5 to 15 is preferable. In this instance, the hardness is in the following relation: When the hardness of a contact charging member obtained by curing a mixture of x parts by weight of the polymeric elastic material A, (100−x) parts by weight of the polymeric elastic material B, y parts by weight of the conductive pigment, z parts by weight of a cross-linking agent and w parts by weight of other additives is represented by $H_{AB}$, the hardness of a contact charging member obtained by curing under the same conditions a mixture of 100 parts by weight of the polymeric elastic material A, y parts by weight of the conductive pigment, z parts by weight of a cross-linking agent and w parts by weight of other additives can be confirmed as $H_A$. A contact charging member with an excessively high hardness tends to cause a noise or the phenomenon of fusing a developer. On the other hand, a contact charging member with an excessively low hardness tends to cause the contamination of the contact charging member. Thus the $\alpha$ should preferably be in the above range.

The polymeric elastic material A may include EPM, EPDM, norbornane rubber, NBR, chloroprene rubber, natural rubber, isoprene rubber, butadiene rubber, styrene-butadiene rubber, chlorosulfonated polyethylene, hydrin rubber, urethane rubber, SBS and SEBS, which are suitable as the material. The polymeric elastic material B may include silicone rubber, which is particularly suitable for use in combination.

The polymeric elastic material A and the polymeric elastic material B may preferably be blended in a ratio (weight ratio) of A/B=10/90 to 90/10, and preferably 30/70 to 70/30. The conductive pigment may include carbon fiber, metal oxides such as zinc oxide and tin oxide, powder of metals such as nickel and silver, graphite, and carbon black, which can be optionally subjected to surface treatment to change the affinity for the resin. The conductive pigment may be compounded in an amount of from 0.5 to 300 parts by weight, preferably from 3 to 100 parts by weight, to 100 parts by weight of the polymeric elastic material A.

The polymeric elastic body comprised of the materials blended as in the above has a volume resistivity of from $10^3$ to $10^{12}$ Ω·cm, and can give good results.

A protective layer may be optionally further provided as an upper layer, whereby physical stability can be improved, e.g., by preventing the charging member wearing, the additives exuding from the layer under the protective layer, or foreign matters adhering to the surface of the charging member.

The protective layer may comprise a urethane resin, a polyamide resin, a fluorine resin, a silicone resin or an olefin resin, styrene resin, which may be used alone or in combination. A conductivity-providing material such as carbon black or metal powder may be optionally added thereto.

FIG. 1 shows a typical example of the construction of the contact charging member according to the present invention. The numeral 2 denotes a roll-like contact charging member coming in contact with a photosensitive drum under a given pressure, which is comprised of a metal core 2a, a conductive layer 2b and a protective layer 2c. In Examples below, 2 has an outer diameter of 12 mm, the core metal 2a has a diameter of 6 mm, and the upper protective layer 2c has a thickness of from 10 to 100 μm.

Figure 2:
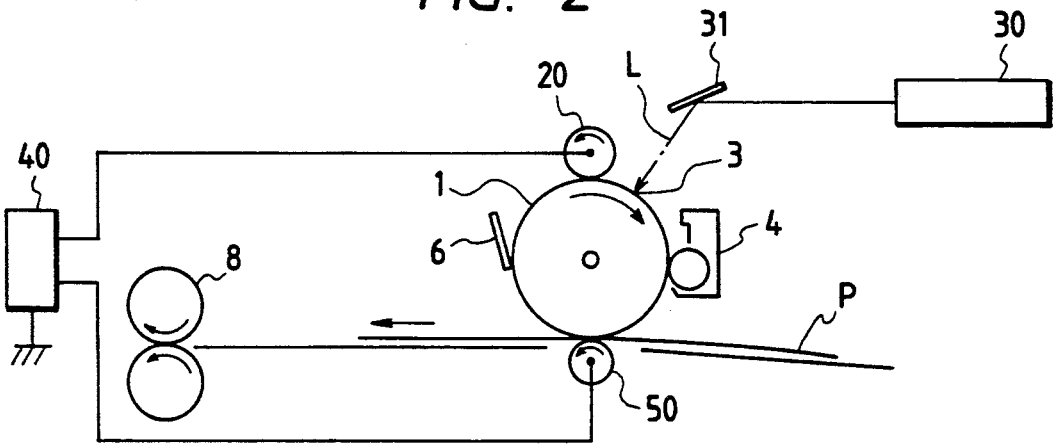
FIG. 2 illustrates an electrophotographic apparatus in which the contact charging member according to the present invention is applied.

FIG. 2 shows a typical example in which the contact charging member of the present invention is applied.

In FIG. 2, the numeral 1 denotes a photosensitive member. The photosensitive member is charged by the operation of a contact charging means 20 according to the present invention. This charging means comprises a conductive roller (hereinafter "charging roller") brought into contact with the photosensitive member 1. The charging roller 20 is always kept pressed against the surface of the photosensitive member 1 under a given pressure (for example, under a linear pressure of from 10 to 100 g/cm). In the present example, it rotates passively in accordance with the rotation of the photosensitive member 1. Alternatively, the charging roller 20 may be actively driven by a driving source to rotate at a given peripheral speed, in the same or reverse direction of the photosensitive member 1, or it may be kept unrotatably contact under pressure with the rotating photosensitive member 1.

The toner image formed on the photosensitive member 1 is transferred to a transfer medium P by roller transfer. The numeral 50 denotes a conductive transfer roller, where the same one as the above charging roller 20 is used. It is in contact with the surface of the photosensitive member 1 under a given pressure and, in the present example, is passively rotated in accordance with the rotation of the photosensitive member 1.

The numeral 40 denotes an electric source from which voltages are applied to the charging roller 20 and the transfer roller 50.

The numeral 30 denotes a known laser scanner unit, by which laser beam scanning exposure L is made corresponding with image signals on the surface of the photosensitive member 1 through a mirror 31, and thus an electrostatic latent image is formed. The latent image thus formed is developed by reverse development by means of a developer assembly 4, and thus toner images are successively formed on the photosensitive drum. The resulting toner-developed image is then successively transferred by means of the conductive transfer roller 50, to the surface of a transfer medium P fed from a paper feed section (not shown) and sent between the photosensitive member 1 and the transfer means 5 in the manner synchronized with the rotation of the photosensitive member 1.

The transfer medium P on which the images have been transferred is separated from the surface of the photosensitive member and sent to an image-fixing device 8, where the image is fixed and then sent out to the outside as a transcript (a copy).

The remained toner on the surface of the photosensitive member 1 after transfer of images, is removed, using a cleaning device 6. Thus the photosensitive member is cleaned on its surface, and is then repeatedly used for the formation of images.

For an electrophotographic apparatus constitution, plural components selected from the constituents such as the above photosensitive member, developing means and cleaning means can be joined as one device unit so that the unit can be freely mounted on or detached from the body of the apparatus. For example, at least one of the charging means, the developing means and the cleaning means may be held into one unit together with the photosensitive member so that the unit can be freely mounted or detached using a guide means such as a rail provided in the body of the apparatus. Here, the above device unit may be constructed so as to be joined together with the charge means and/or the developing means.

In the case when the electrophotographic apparatus is used as a copying machine or a printer, the light reflected from, or transmitted through an original, or the original image itself are read and converted to signals, according to the signals, optical image exposure L is performed by the scanning of a laser beam, driving of an LED array, or driving of a liquid crystal shutter array.

Figure 3:
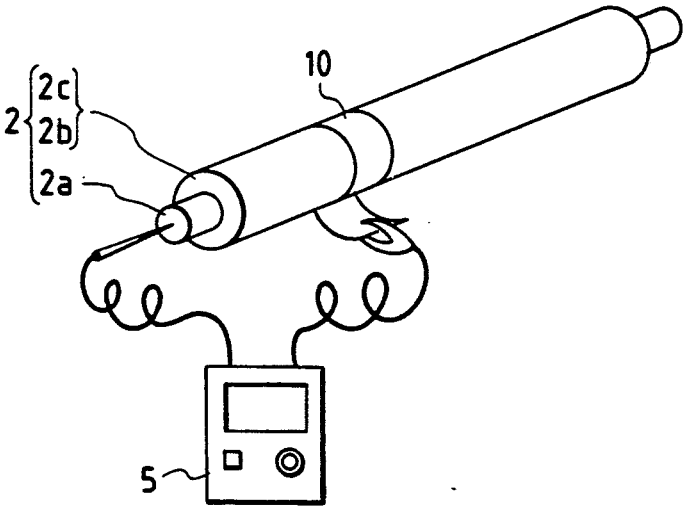
FIG. 3 illustrates a method of measuring the resistance of a contact charging member.

FIG. 3 illustrates a method of measuring the resistance of the charging roller. An aluminum electrode 10 is fitted around the periphery of the charging roller 2, and the resistance between it and the core metal 2*a* of the charging roller is measured with a resistivity gauge 5.

Figure 4:
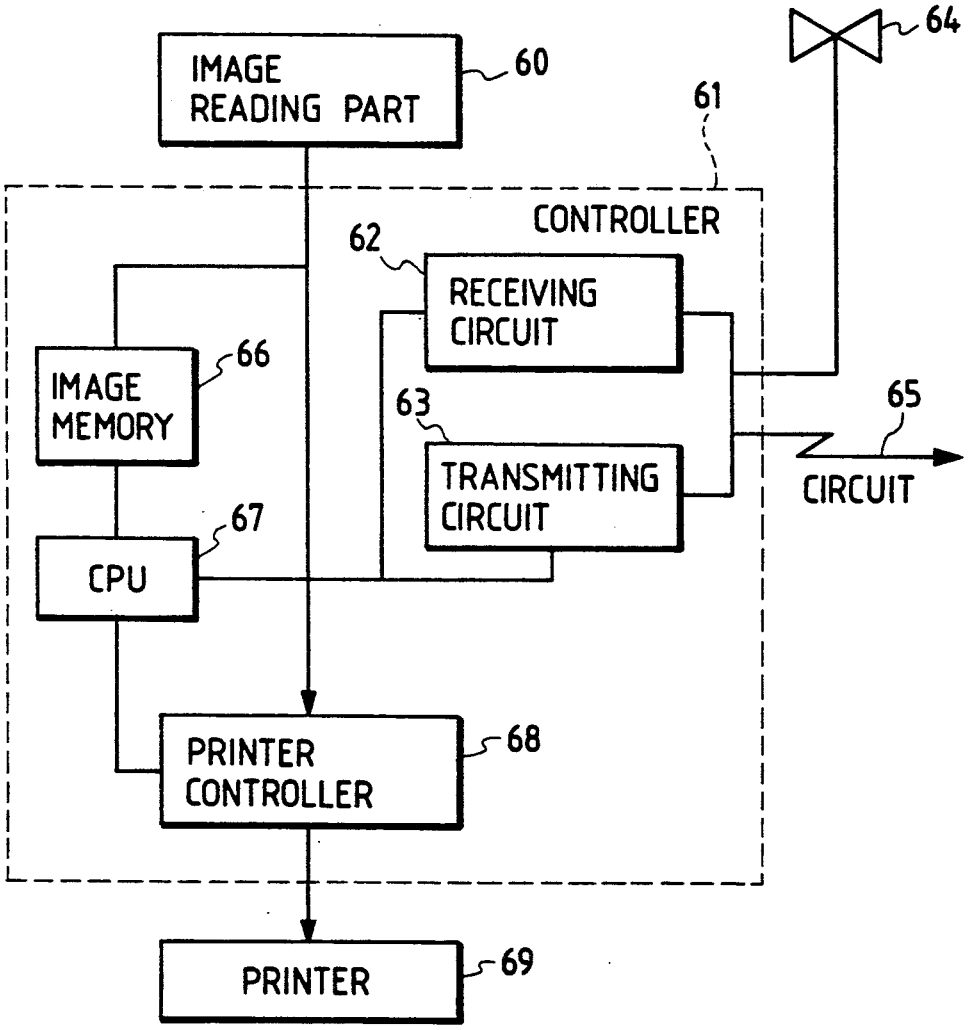
FIG. 4 is a block diagram of a facsimile machine in which an electrophotographic apparatus using the contact charging member according to the present invention is used as a printer.

When the electrophotographic apparatus using the contact charging member of the present invention is used as a printer of a facsimile machine, the optical image exposure L is used for the printing of received data. FIG. 4 illustrates an example thereof in the form of a block diagram.

A controller 61 controls an image reading part 60 and a printer 69. The controller 61 itself is controlled by CPU 67. Image data outputs from the image reading part is sent to the other facsimile station through a transmitting circuit 63. Data received from the other station are sent to a printer 69 through a receiving circuit 62. Given image data are stored in an image memory 66. A printer controller 68 controls the printer 69. The numeral 64 denotes a telephone.

An image received from a circuit 65 (image information from a remote terminal connected through the circuit) is demodulated in the receiving circuit 62, and then successively stored in an image memory 66 after the image information is decoded by the CPU 67. Then, when images for at least one page have been stored in the memory 66, the image recording for that page is carried out. The CPU 67 reads out the image information for one page from the memory 66 and sends the coded image information for one page to the printer controller 68. The printer controller 68, having received the image information for one page from the CPU 67, controls the printer 69 so that the image information for one page is recorded.

The CPU 67 receives image information for next page in the course of the recording by the printer 69.

Images are received and recorded as mentioned above.

EXAMPLES

The present invention is described below by giving Examples.

EXAMPLE 1

Using a twin roll, 100 parts by weight of a polyolefin synthetic rubber, EPDM, RX-007 (trade name; available from Mitsui Petrochemical Industries, Ltd.), 10 parts by weight of Ketjen Black EC (trade name; available from Ketjen Black International Co.) and 30 parts by weight of liquid paraffin for industrial use, PW380 (trade name; available from Idemitsu Kosan Co., Ltd.) were blended to give a component 1.

Next, a silicone rubber, KE520U (trade name; available from Shin-Etsu Chemical Co., Ltd.) (a component 2), and the component 1 were blended in a ratio of component 1/component 2=50/50, followed by the addition of 1.6 parts by weight of dicumyl peroxide to give a compound (hereinafter "silicone type rubber 1").

This silicone type rubber 1 was transfer-molded into a roller and then vulcanized at 160° C. for 10 minutes. Thereafter, the resistance of the roller was measured at its every part to reveal that the thus obtained roller had a stable volume resistivity in the range of from $9.0\times10^6$ to $2.5\times10^7$ Ω·cm.

Thereafter, methylol nylon was applied on the surface of the roller with a film thickness of 10 μm. A charging apparatus incorporated with this roller was fitted under a total contact pressure of 1,000 g, in the position of a primary charging assembly of a cartridge used in LBP8-II (manufactured by Canon Inc.). A bias of $V_{DC}=-700$ V, $I_{AC}=120$ μA and f=1,000 Hz was then applied to its core metal to observe the images formed. Good images were obtained without occurrence of both defective images caused by leaks and images with black spots.

This polymeric elastic body had a hardness of 40°, while EPDM had a hardness of 45°.

Figure 5:
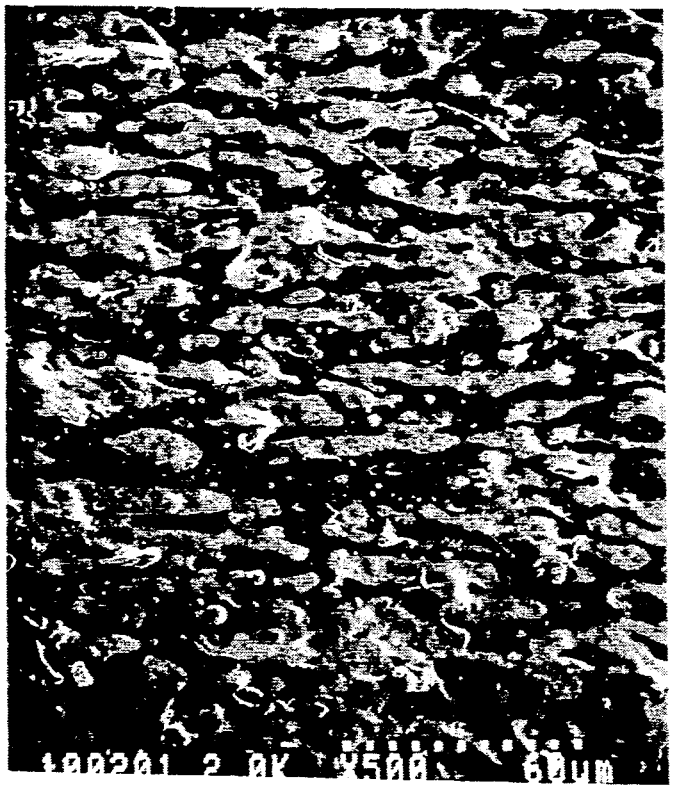
FIG. 5 is a photograph to show a particulate structure of the conductive layer of a contact charging member prepared in Example 1.

FIG. 5 is a cross-sectional photograph of the conductive layer of the contact charging member produced in the present Example. The photograph was taken at a magnification of 500 by SEM, and then observed. In the photograph what looks like a black sea corresponds to the component 1 (EPDM), and what looks like white islands corresponds to the component 2 (silicone rubber), and carbon black can be recognized to be selectively present in the former.

COMPARATIVE EXAMPLE 1

The same procedure as Example 1 was repeated except that the EPDM of Example 1 was replaced with silicone rubber. The resistance of the roller was measured at its every part to reveal that the resistance unevenness was present with a variation of the volume resistivity from $3.5\times10^4$ to $1.0\times10^{10}$ Ω·cm.

Using this roller, the operation as in Example 1 was repeated to make observations on images. As a result, defective images with black lines caused by leaks, and also defective images having black spots, which occurred at the sites corresponding to high-resistance sites were formed.

Hardness measured in the same manner as in Example 1 was 37°.

COMPARATIVE EXAMPLE 2

Example 1 was repeated except that the silicone type rubber 1 of Example 1 was replaced with EPDM. The resistance of the roller was measured at its every part to reveal that the resistance unevenness was present with a variation of the volume resistivity from $4.6\times10^4$ to $7.8\times10^{10}$ Ω·cm.

Using this roller, the operation as in Example 1 was repeated to make observations on images. As a result, defective images with black lines caused by leaks, and also defective images having black spots which occurred at the sites corresponding to high-resistance sites, were formed.

Hardness measured in the same manner as in Example 1 was 43°.

EXAMPLE 2

Using a twin roll, 150 parts by weight of norbornane rubber (polyethylidene norbornane; hereinafter "ENB"), 10 parts by weight of Ketjen Black EC (trade name; available from Ketjen Black International Co.) and 30 parts by weight of di(2-ethylhexy)-phthalate (hereinafter "DOP") were blended to give a component 3.

Next, the component 2 as used in Example 1 and the component 3 were blended in a ratio of component 3/component 2=50/50, to which 2.0 parts by weight of dicumyl peroxide was added to give a compound (hereinafter "silicone-type rubber 2").

The subsequent procedure was carried out in the same manner as in Example 1 except that this silicone type rubber 2 was used in place of the silicone type rubber 1, and the resistance of the roller was measured at its every part. The roller thus obtained had a constant volume resistivity in the range of from $5.5\times10^6$ to $3.2\times10^7$ Ω·cm. Observations on images also confirmed that good images could be obtained.

Hardness measured in the same manner as in Example 1 was 39°. The hardness of the norbornane rubber was 47°. The SEM observation also confirmed the presence of a black sea comprising norbornane rubber and white islands comprising silicone rubber, and it was confirmed that carbon black was selectively dispersed in the norbornane rubber.

EXAMPLE 3

Using a twin roll, 100 parts by weight of a diene synthetic rubber NBR (acrylonitrile-butadiene rubber) containing 35% of bound acrylonitrile and having a Mooney viscosity of 32 at 100° C., 10 parts by weight of Ketjen Black EC (trade name; available from Ketjen Black International Co.) and 30 parts by weight of DOP and 1 part by weight of a phenol type age-resister were blended to give a component 4.

Next, using a fluorosilicone rubber FE241u (trade name; Shin-Etsu Chemical Co., Ltd.) as a component 5, the component 4 and the component 5 were blended in a ratio of component 4/component 5=50/50, and 1.6 parts by weight of dicumyl peroxide was added to the mixture to give a compound (hereinafter "fluorosilicone type rubber").

The subsequent procedure was taken in the same manner as in Example 1 except that the fluorosilicone type rubber was used in place of the silicone type rubber 1, and the resistance of the roller was measured at its every part to reveal that the roller obtained had a stable volume resistivity in the range of from $3.0\times10^6$ to $9.8\times10^6$ Ω·cm. Observation on images also confirmed that good images were obtained.

Hardness measured in the same manner as in Example 1 was 40°. The hardness of the NBR was 44°.

The SEM observation also confirmed the presence of white islands-like area comprising silicone rubber in the black sea-like area comprising NBR, and it was confirmed that carbon black was selectively dispersed in the NBR.

EXAMPLE 4

A roller was formed in the same manner as in Example 1 except that the component 1 and the component 2 were blended in a ratio of 40/60. Thereafter, a coating composition prepared by dispersing 3% of carbon black in a one-pack type silicone RTV was applied to give a film thickness of 10 μm.

A charging apparatus incorporated with this roller was fitted to the position of a transfer assembly of LBP8-II (manufactured by Canon Inc.). Observation made on images revealed that good images were obtained.

EXAMPLE 5

A roller was formed in the same manner as in Example 1.

Next, a coating composition was prepared by dissolving in DMF an urethane resin having a specific gravity of 1.2 and a hardness of 80° to give a solid content of 5% and thereafter dispersing 3% of carbon black in the solution, and it was applied on the roller to give a film thickness of 15 μm.

A coating composition was further prepared by dispersing 3% of carbon black in an emulsion type coating material containing ethylene tetrafluoride resin to coat the roller giving a film thickness of 5 μm. Using this roller, the operation as in Example 1 was repeated to make observation on images. As a result, good images were obtained.

We claim:

1. A contact charging member having a conductive layer comprising a conductive pigment and a blend of at least two kinds of polymeric elastic materials A and B, wherein the elastic material A has a higher affinity for the conductive pigment than the elastic material B.

2. A contact charging member according to claim 1, wherein said conductive layer has a specific resistivity of from $1\times10^3$ to $1\times10^{12}$ Ω·cm.

3. A contact charging member according to claim 1, wherein said conductive layer is provided thereon with a protective layer.

4. A contact charging member according to any one of claims 1 to 3, wherein said polymeric elastic material A is a polyolefin polymer and said polymeric elastic material B is silicone rubber.

5. A contact charging member according to claim 4, wherein said conductive pigment is carbon black.

6. A contact charging member according to any one of claims 1 to 3, wherein said polymeric elastic material A and said polymeric elastic material B are blended in a weight ratio of A/B=10/90 to 90/10.

7. A contact charging member according to any one of claims 1 to 3, wherein said polymeric elastic material A and said polymeric elastic material B are blended in a weight ratio of A/B=30/70 to 70/30.

8. A contact charging member according to any one of claims 1 to 3, wherein the amount of the conductive pigment dispersed in the polymeric elastic material A is not less than twice the amount of the conductive pigment dispersed in said polymeric elastic material B.

9. A contact charging method comprising the steps of:

applying a voltage to a contact charging member having a conductive layer comprising a conductive pigment and a blend of at least two kinds of polymeric elastic materials A and B, wherein the elastic material A has a higher affinity for the conductive pigment than the material B; and charging a charge-receiving member during the state in which said contact charging member is in contact with the charge-receiving member.

10. A contact charging method according to claim 9, wherein said voltage applied to the contact charging member is a voltage obtained by superimposing a direct voltage on an alternating voltage.

11. A device unit comprising:

a contact charging member having a conductive layer comprising a conductive pigment and a blend of at least two kinds of polymeric elastic materials A and B, wherein the material A has a higher affinity for the conductive pigment than the material B; and a charge-receiving member which is in contact with and charged by said contact charging member;

said contact charging member and said charge-receiving member are contained within one unit so that the unit can be freely attached to or detached from the body of an apparatus.

12. An electrophotographic apparatus, comprising a photosensitive member, a means for forming latent images, a means for developing the latent image formed, and a means for transferring the developed image, wherein:

a charging member of said means for forming latent images is a contact charging member having a conductive layer comprising a conductive pigment and a blend of at least two kinds of polymeric elastic material A and B, wherein the material A has a higher affinity for the conductive pigment than the material B.

13. A facsimile machine, comprising an electrophotographic apparatus and a receiving means for receiving image information from a remote terminal, said electrophotographic apparatus comprising a photosensitive member, a means for forming a latent image, a means for developing the latent image formed, and a means for transferring the developed image, wherein:

a charging member of said means for forming a latent image is a contact charging member having a conductive layer comprising a conductive pigment and a blend of at least two kinds of polymeric elastic materials A and B, wherein the material A has a higher affinity for the conductive pigment than the material B.

* * * * *